US007918775B2

(12) United States Patent
Pohlmann

(10) Patent No.: US 7,918,775 B2
(45) Date of Patent: Apr. 5, 2011

(54) METHOD AND DEVICE FOR CREATING A HINGE-LIKE BENDABLE ZONE IN A SHEET OF PAPER, PAPERBOARD, CARDBOARD OR FOIL

(75) Inventor: Jürgen Pohlmann, Luebbecke (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 11/827,390

(22) Filed: Jul. 11, 2007

(65) Prior Publication Data

US 2008/0020917 A1 Jan. 24, 2008

(30) Foreign Application Priority Data

Jul. 18, 2006 (DE) ..... 10 2006 033 117

(51) Int. Cl.
*B31B 1/25* (2006.01)

(52) U.S. Cl. ..... 493/402; 493/396; 493/397; 493/400; 493/401

(58) Field of Classification Search ..... 493/395–397, 493/400–403, 463
See application file for complete search history.

(56) References Cited

U.S. PATENT DOCUMENTS 2,117,220 A * 5/1938 Sieg ..... 493/354
3,917,255 A * 11/1975 Watrous ..... 493/399
4,410,316 A * 10/1983 Yoke ..... 493/399
4,731,047 A * 3/1988 Lobb ..... 493/10
4,936,818 A * 6/1990 Holohan, Jr. ..... 493/396
5,138,923 A * 8/1992 Kent et al. ..... 83/665
5,393,295 A * 2/1995 Knecht ..... 493/403
5,533,889 A * 7/1996 Scalia et al. ..... 425/315
5,888,183 A * 3/1999 Ruthenberg et al. ..... 493/366
6,364,590 B1 * 4/2002 Gayoso ..... 412/18
6,508,751 B1 * 1/2003 Weishew et al. ..... 493/59
6,572,519 B1 6/2003 Harris
6,682,468 B2 * 1/2004 Lauderbaugh ..... 493/59
6,699,167 B2 * 3/2004 Manley ..... 493/464

FOREIGN PATENT DOCUMENTS

DE 200 22 488 U 1 9/2001

* cited by examiner

*Primary Examiner* — Christopher Harmon
(74) *Attorney, Agent, or Firm* — Alix, Yale & Ristas, LLP

(57) ABSTRACT

In a method for producing a hinge-like bend line (3*a,b,* 4*a,b* or 5*a,b*) in a sheet (1) of paper, paperboard, cardboard or foil, particularly a brochure cover, by rotatively driven tools (7.1, 7.2), the bending line (3*a,b,* 4*a,b* or 5*a,b*) is produced by roll bending without scoring the material in the form of a scoring bead. The roll bending is preferably realized by the cooperation of a tool edge (12*a*) of a first rotary tool member (8.1) with a conical outside surface (11*a*) of a second rotary tool member (9.1). The roll bending process lowers the bending resistance of the sheet (1) in the region of the bending point (3*a,b,* 4*a,b* or 5*a,b*), wherein the sheet (1) is simultaneously pre-bent in a certain direction along the bending point (3*a,b,* 4*a,b*), e.g., in order to take into account the position of the brochure cover on the book block at the spine edges (the sheet is pre-bent inward in a U-shaped fashion).

20 Claims, 2 Drawing Sheets

METHOD AND DEVICE FOR CREATING A HINGE-LIKE BENDABLE ZONE IN A SHEET OF PAPER, PAPERBOARD, CARDBOARD OR FOIL

BACKGROUND

The present invention pertains to a method and a device for creating a hinge-like bendable zone in a sheet of paper, paperboard, cardboard or foil, particularly a brochure cover, by means of rotatively driven tools.

Methods in which material is compressed and/or displaced are conventionally employed for creating hinge-like bending zones or lines in a sheet of paper, paperboard, cardboard or foil, especially for use in covers for books or brochures (collectively, "cover sheets"). In this case, the sheet is scored along the bending line such that the bending resistance in the bending line is reduced and the stability of the sheet is barely changed.

Various scoring devices with rotatively driven tools are listed on page 116 of the technical book "Industrial Bookbinding" by Dieter Liebau and Inès Heinze, Publishing House Beruf+Schule, 2001. An upper tool in the form of a scoring blade or a scoring disk carries out the scoring process in cooperation with a lower tool that may consist of a sleeve with a circumferential radial groove or be composed of two opposite sleeves with rounded edges, the gap between which is adjustable. It is also known to utilize a scoring blade for directly scoring against a cylindrical rubber roller.

In order to realize the scoring with adequate quality such that a uniform scoring bead is produced and no tearing of the upper and lower sides occurs, the geometric relations (width of the scoring blade, width of the groove in the lower tool and depth of penetration of the scoring blade) need to be adapted to the respective material to be scored. It may even be required to exchange the tools if the product thickness varies significantly.

DE 200 22 488 U1 describes a scoring device in which the scoring blade consists of an elastic ring that is exchangeably accommodated in a groove of the upper tool. The upper tool features several grooves of different widths and depths that are arranged adjacent to one another such that rings of different diameters and/or geometries can be inserted into the upper tool. In addition, the lower tool features a series of adjacently arranged grooves that can be allocated to the respective rings of the upper tool with respect to the material to be scored and the material thickness by means of a color code. In this case, it is disadvantageous that rings need to be exchanged and that the upper and lower tools need to be positioned relative to one another anew in accordance with a predetermined allocation matrix if the material or the material thickness changes, wherein these procedures require a significant set-up effort.

SUMMARY

The present invention is based on the objective of developing a method and a device for creating a hinge-like bendable line in a sheet of paper, paperboard, cardboard or foil, particularly a brochure cover, i.e., cover sheet, by means of rotatively driven tools, wherein the method and device make it possible to process a broad variety of sheet materials and sheet thicknesses with the same tool set of upper and lower tools and to quickly adjust the device to the respective sheet to be processed. A related objective is improving the additional processing of the processed sheet.

This objective is attained in that the bending line is created by means of roll bending without scoring the material in the form of a scoring bead. The conventional allocation between the scoring blade and the lower tool that serves as the scoring counterpart is eliminated because the sheet material is no longer displaced into a defined groove at the bending point. The roll bending process lowers the bending resistance of the sheet in the region of the bending point, whereby the sheet is simultaneously pre-bent in a certain direction along the bending point, e.g., in order to take into account the position of the brochure cover on the book block at the spine edges (the sheet is pre-bent inward in a U-shaped fashion in this case) or to simplify the opening and closing of the brochure cover on the assembled brochure (the sheet is pre-bent inward or outward in dependence on the desired opening characteristics).

The roll bending is preferably realized by the cooperation of a tool edge of the first rotary tool with a conical outside surface of the second rotary tool such that the respective sheet can be pre-bent in a defined direction. In another variation of the method, the roll bending is realized by the cooperation of essentially complementary conical outside surfaces of the two rotary tools, whereby an edge of one outside surface respectively cooperates with the outside surface of the other rotary tool. This causes the sheet to be bent in opposite directions in the form of a Z-bend such that, for example, a box-shaped brochure cover contour can be realized during the processing of the spine edges.

The objective is attained with a device in which the first rotary tool features a substantially radially projecting tool edge, and the second rotary tool features a conical outside surface that is inclined toward the rotational axis and cooperates with the tool edge of the first rotary cool while it acts upon the sheet.

According to one advantageous embodiment, the radially projecting tool edge has an essentially triangular cross section such that the required stability of the tool edge is ensured. In another advantageous embodiment, the radially projecting tool edge is rounded with a defined radius such that the sheet being processed is provided with a semicircular depression. It is advantageous that the tool edge consists of an elastic material. This enables the tool edge to yield in order to protect the sheet material from being overstressed or destroyed.

In order to realize a desired bending direction, for pre-bending the sheet inward or outward, another advantageous embodiment proposes that the second rotary tool with the outside surface that is inclined toward the rotational axis can be used as upper or as lower tool. The inclination of the outside surface is preferably greater than 30°, wherein an inclination of the outside surface between 45° and 70° proved particularly advantageous.

In another embodiment of the device, both rotary tools feature conical outside surfaces that are essentially inclined in opposite directions and complement one another, wherein a radially projecting edge of one outside surface respectively cooperates with the outside surface of the other rotary tool. The bending point is subjected to uniform pressure over a defined width such that a changed appearance of the bending point is realized in comparison with instances in which the bending point is processed with a single tool edge that cooperates with an outside surface. In addition, the sheet is practically pre-bent in opposite directions in the form of a Z-bend such that a step is realized at the bending point. A box-shaped contour is produced in the sheet due to the processing of a bending point that extends parallel thereto and features a mirror-inverted step, wherein this box-shaped contour is advantageous with respect to the arrangement of a brochure cover sheet on the book block spine. The bending point with a Z-bend is also suitable for use as a folded joint because the respective bends of the Z-bend essentially neutralize one another.

In another advantageous embodiment, both rotary tools can be adjusted relative to one another in the axial direction. This means that the rotary tools can be adjusted to the respective sheet thickness or that the degree of material compression can be adapted to the properties of the sheet material. It is furthermore advantageous that the axial spacing between the two rotary tools is adjustable such that it is possible, for example, to influence the shape of the Z-bend.

BRIEF DESCRIPTION OF THE DRAWING

The characteristics of preferred embodiments of the present invention are described in greater detail below with reference to the accompanying drawing in which.

DETAILED DESCRIPTION

Figure 1:
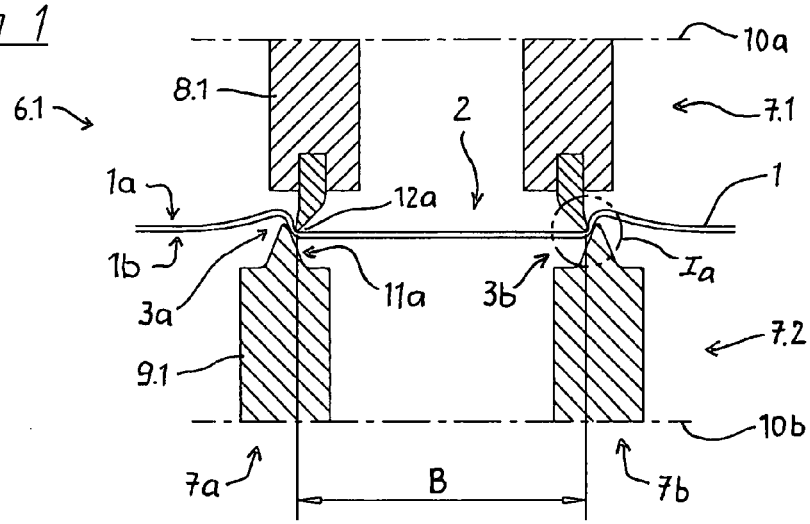
FIG. 1 is a sectional representation of a first embodiment of an inventive roll bending device.

FIG. 1 shows a roll bending device 6.1 for producing hinge-like bending lines 3*a,b* that border the spine region 2 in a cover sheet 1, for e.g., printed products such as books and brochures. The cover sheet 1 is respectively bent inward referred to its inner and its outer side 1*a* and 1*b* along bending lines 3*a,b* such that the spine region 2 is realized with a U-shaped cross section and the cover sheet 1 can be advantageously attached to a glued book block spine in a flawless fashion during the additional processing that is not illustrated in greater detail.

Figure 2A:
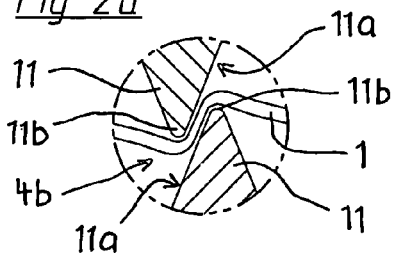
FIG. 2*a* shows a detail of the roll bending processing zone in FIG. 2.
Figure 2:
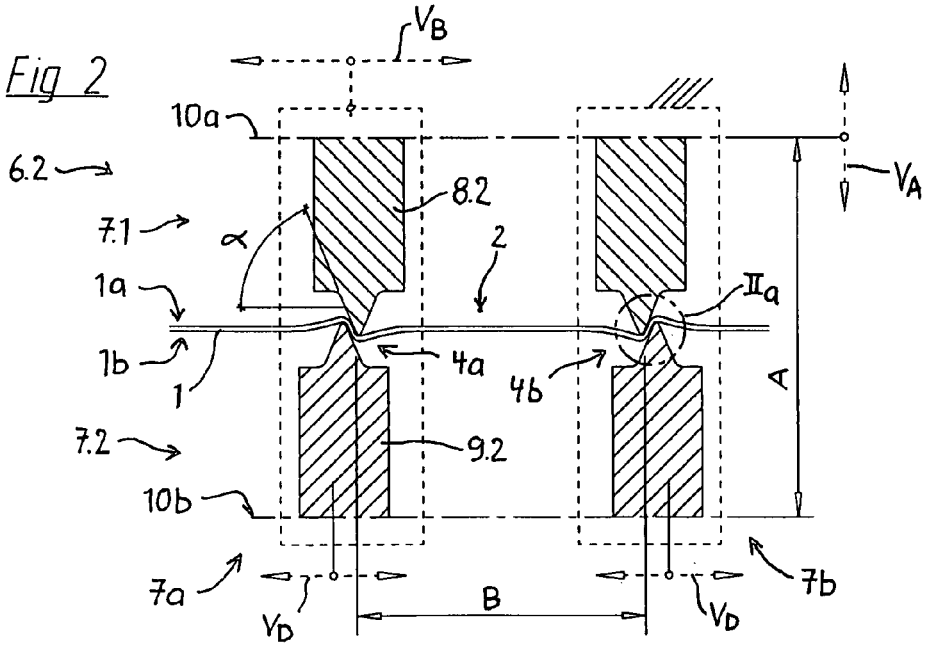
FIG. 2 is a sectional representation of a second embodiment of a roll bending device.
Figure 3:
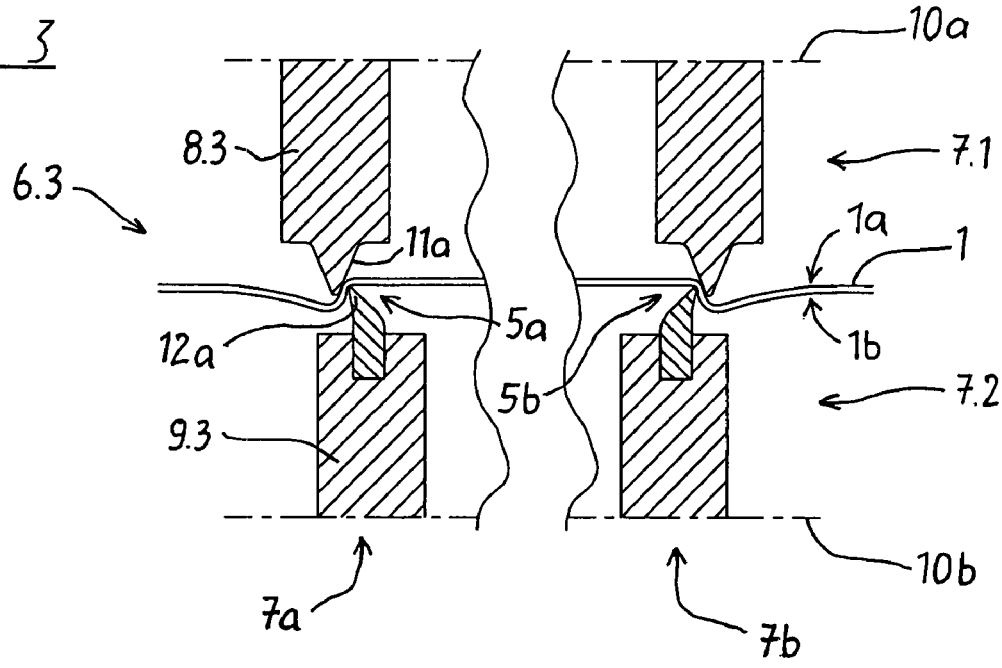
FIG. 3 shows a roll bending device according to FIG. 1, in which the arrangement of the rotary tools is reversed.

FIG. 2 shows an alternative roll bending device 6.2 that makes it possible to realize the cover sheet 1 with a box-shaped contour in the spine region 2, namely by bordering the spine region 2 with bending lines 4*a,b* that are respectively bent in a Z-shaped fashion. FIG. 3 shows a roll bending device 6.3 that is reversed in comparison with the variation shown in FIG. 1 and serves for realizing outwardly bent bending lines 5*a,b* that preferably form hinges of the front and the rear cover and are positioned at a defined distance from the spine region 2.

The disclosed roll bending devices 6.1 to 6.3 respectively consist of left and right pairs 7*a,b* of roll bending tools that are respectively realized and arranged in a mirror-inverted fashion, wherein these pairs of roll bending tools are spaced apart by the spine width B in the embodiments shown in FIGS. 1 and 2. Each pair 7*a* and *b* of roll bending tools features an upper tool 7.1 and a lower tool 7.2. The tools 7.1 and 7.2 are rotatively driven in opposite directions, wherein their rotational axes 10*a* and *b* are spaced apart from one another by an axial distance A.

In the roll bending device 6.1 according to FIG. 1, the upper tool 7.1 has a first rotary tool member 8.1 with a circumferentially projecting ring 12, the circumferential tool edge 12*a* of which is rounded with a defined radius 12*b*. The lower tool 7.2 has a second rotary tool member 9.1 with a conical outside surface 11*a* that is inclined toward the rotational axis 10*b* and features a projection 11*a* of triangular cross section.

The tool edge 12*a* of the first rotary tool member 8.1 cooperates with the inclined, conical outside forming surface 11*a* of the second rotary tool member 9.1, whereby the continuously transported cover sheet 1 lying therebetween is deformed in accordance with the roll bending principle. In this context, "conical" should be understood as exemplified by the inclined, substantially frustoconical surface 11*a* observable as, e.g., the left rotary tool 9.1 is viewed along the rotational axis 10*b* from the spine region 2.

In this embodiment, the inclination a of the outside forming surface 11*a* relative to the rotational axis 10*b* amounts to approximately 67.5°, but it should be noted in this context that the tools may be realized with any angle $\alpha$ between 30° and 90°.

Figure 1A:
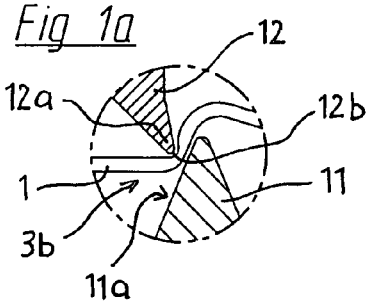
FIG. 1*a* shows a detail of the roll bending processing zone in FIG. 1.

The detail shown in FIG. 1*a* elucidates how the cover sheet 1 is compressed by the tool edge 12*a* in the bending line 3*b* cooperatively working against the confronting tool surface 11*a*, wherein a chamfer of sorts is produced in the cover sheet 1 due to the inclined outside forming surface 11*a* that acts as a counter bearing. The tool edge 12*a* projects substantially radially relative to axis 10*a* into confronting relationship with the inclined forming surface 11*a* either transversely (FIG. 1*a*) or substantially in parallel (FIG. 2*a*). These edges or inclined surfaces can have a curvature.

As mentioned above, FIG. 3 shows a roll bending device 6.3 that is reversed in comparison with the embodiment shown in FIG. 1. In this case, the rotary tool member 8.3 that serves as the upper tool 7.1 has the inclined outside forming surface 11*a* while the rotary tool member 9.3 used as the lower tool 7.2 features the tool edge 12*a*.

In the second embodiment of the roll bending device 6.2 shown in FIG. 2, rotary tool members 8.2 and 9.2 that are essentially realized identically are used as upper and lower tools 7.1 and 7.2. The rotary tool members 8.2 and 9.2 respectively feature a projection 11 of triangular cross section analogous to that described above with reference to the rotary tool members 9.1 and 8.3. The two outside forming surfaces 11*a* are inclined in a complementary fashion such that the rotary tool members 8.2 and 9.2 with their outside surfaces 11*a* can be adjusted relative to one another. In this context, see the detail illustrated in FIG. 2*a*.

The revolving projecting edge of one rotary tool member 8.2 or 9.2 respectively cooperates with the outside forming surface 11*a* of the other rotary tool member 9.2 or 8.2 in the form of a radiused tool edge 11*b* in this case. The cover sheet 2 is bent inward once along the bending line 4*a* or 4*b* and bent outward again once directly adjacent thereto such that a bending point of essentially Z-shaped cross section is produced.

In the embodiment shown in FIG. 2, the right pair 7*b* of roll bending tools is arranged stationarily while the left pair 7*a* of roll bending tools can be adjusted with respect to the spine width B as symbolically indicated with the reference symbol $V_B$.

Another adjustment $V_A$ can be realized by varying the axial distance A between the two tools 7.1 and 7.2. This adjustment makes it possible to vary the working position of the tool edge 12*a* on the outside forming surface 11*a*. In the second embodiment of the roll bending device 6.2 shown in FIG. 2, this makes it possible to vary the distance between the two oppositely directed chamfers in the bending line 4*a,b* or its compressed surface in the cover sheet, respectively. In this context, see FIG. 2*a*.

In addition, it is possible to realize an adjustment $V_D$ of each pair 7*a* and *b* of roll bending tools in order to adjust the processing distance of the tool edge 12*a* (or 11*b*) relative to the corresponding outside forming surface 11*a* in the sense of a basic setting. This also makes it possible, in principle, to realize a defined adjustment of the cover sheet thickness.

However, an adjustment $V_D$ of the processing distance as well as an adjustment $V_A$ of the axial distance A is not required during the normal operation of an inventive roll bending device 6.1 to 6.3 of this type. Various cover sheet materials and thicknesses can be processed with one and the same adjustment of the pairs 7*a* and *b* of roll bending tools. Bending lines 3*a,b*, 4*a,b* or 5*a,b* of adequate quality are produced in all instances, wherein these bending lines are characterized in that they bend easily and feature no torn surfaces.

In order to carefully process the cover sheet 1, the ring 12 and therefore the tool edge 12*a* may consist of an elastic material. However, it was determined that hard tool edges 12*a* and outside surfaces 11 are advantageous with respect to producing high-quality bending lines 3*a,b*, 4*a,b* or 5*a,b* in a multitude of different sheet materials.

The invention claimed is:

1. A device for producing a hinge-like bending line in a cover sheet transported in a transport direction, comprising:

upper and lower tools having respective first and second rotary tool members driven in opposite directions about respective parallel rotation axes;

said first rotary tool member having a circumferentially continuous projecting tool edge, and said second rotary tool member having a circumferentially continuous outside forming surface that is inclined relative to the rotational axis of the second rotary tool member;

a cover sheet passing between the upper and lower rotating tools;

with the projecting edge of the first rotary tool member and the outside forming surface producing a bending line on the cover sheet by roll bending the sheet without scoring the sheet with a scoring bead;

wherein said first rotary tool member has a single, circumferentially continuous, radially outward projection, and said second rotary tool member has a single, circumferentially continuous, radially outward projection; and wherein each projection has outwardly converging sides including a side that is inclined relative to the respective rotational axis such that the converging sides of the projection on the first tool member define the projecting tool edge which confronts and cooperates with a single inclined side of the projection on the second tool member defining the outside forming surface.

2. The device of claim 1, wherein the cover sheet is a book cover in which a spine region is to be formed between bend lines spaced apart by a predefined spine width, and the device comprises:

two pair of tool members spaced apart by the predefined spine width, with their rotation axes transverse to the transport direction of the cover sheets;

whereby the sheet passes through both tool members simultaneously, thereby simultaneously producing two parallel bend lines in the transport direction separated by the spine width.

3. The device of claim 2, wherein the bend lines produce a "U" shaped spine region.

4. The device of claim 2, wherein the bend lines are "Z" shaped.

5. The device of claim 1, wherein the converging sides of the projection on the first tool member both angle toward the forming surface.

6. The device of claim 1, wherein both rotary tool members have respective forming surfaces that are inclined in opposite directions as viewed in cross section perpendicularly to the respective rotation axes and substantially complement one another, whereby a substantially radially projecting edge of one forming surface respectively cooperates with the forming surface of the other rotary tool member.

7. The device according to claim 1, wherein the outwardly converging sides that define the tool edge are both inclined relative to the rotation axis of the first tool member, forming a substantially triangular cross section as viewed perpendicularly to the rotation axis of the first rotary tool member, with both said sides that define the tool edge angled toward the inclined outside forming surface the second tool member.

8. The device according to claim 1, wherein the projecting tool edge is rounded with a defined radius as viewed in cross section perpendicularly to the rotation axis of the first rotary tool member.

9. The device according to claim 8, wherein the projecting tool edge consists of elastic material.

10. The device according to claim 1 wherein the inclined forming surface of the second rotary tool member is situated vertically below the projecting tool edge of the first rotary tool member.

11. The device according to claim 1, wherein the outside forming surface is conical as viewed in cross section perpendicularly to the rotation axis of the second rotary tool member and the inclination of the outside forming surface relative to the rotational axis of the second rotary tool member, is greater than 30°.

12. The device according to claim 11, wherein the inclination of the outside surface lies between the 45° and 70°.

13. The device according to claim 8 wherein the projections on both rotary tool members are triangular, both rotary tool members have respective projecting tool edges, and both rotary tool members have respective forming surfaces that are inclined in opposite directions as viewed in cross section perpendicularly to the respective rotation axes and substantially complement one another, whereby the projecting edge of one rotary tool member respectively cooperates with the forming surface of the other rotary tool member.

14. The device according to claim 1 wherein both rotary tool members are adjustable relative to one another along their rotation axes.

15. The device according to claim 1 wherein the perpendicular distance between the rotation axes of the rotary tools is adjustable.

16. The device according to claim 7, wherein the projecting tool edge is rounded with a defined radius as viewed in cross section perpendicularly to the rotation axis of the first rotary tool member.

17. The device according to claim 16, wherein the projecting tool edge consists of elastic material.

18. The device according to claim 1 wherein the inclined forming surface of the second rotary tool member is situated vertically above the projecting tool edge of first rotary tool member.

19. The device according to claim 7 wherein the inclined forming surface of the second rotary tool member is situated vertically below the projecting tool edge of the first rotary tool member.

20. The device according to claim 7 wherein the inclined forming surface of the second rotary tool member is situated vertically above the projecting tool edge of the first rotary tool member.

* * * * *

UNITED STATES PATENT AND TRADEMARK OFFICE

CERTIFICATE OF CORRECTION

PATENT NO. : 7,918,775 B2
APPLICATION NO. : 11/827390
DATED : April 5, 2011
INVENTOR(S) : Pohlmann It is certified that error appears in the above-identified patent and that said Letters Patent is hereby corrected as shown below:

Column 6:

Line 11, after "surface" insert --of--.

Signed and Sealed this
Twenty-eighth Day of June, 2011

David J. Kappos

David J. Kappos
*Director of the United States Patent and Trademark Office*